US005762254A

United States Patent [19]

Prittie et al.

[11] Patent Number: 5,762,254

[45] Date of Patent: Jun. 9, 1998

[54] MECHANISM FOR CHANGING A WEB FEED FROM INTERMITTENT TO CONSTANT MOTION

[75] Inventors: Allan R. Prittie, Islington; Michal Cvercko, Etobicoke, both of Canada

[73] Assignee: Arpeco Engineering Ltd., Ontario, Canada

[21] Appl. No.: 743,682

[22] Filed: Nov. 6, 1996

[51] Int. Cl.[6] ..... B65H 20/24; G11B 15/56

[52] U.S. Cl. ..... 226/118.2; 226/172

[58] Field of Search ..... 226/118, 119, 226/172, 118.1, 118.2

[56] References Cited

U.S. PATENT DOCUMENTS

| | | | |
|---|---|---|---|
| 2,399,155 | 4/1946 | Reed et al. | 226/172 |
| 4,188,110 | 2/1980 | Stange | 226/118 |
| 4,569,285 | 2/1986 | Forno et al. | 226/119 |
| 4,984,728 | 1/1991 | Brinkmeier et al. | 226/172 |

*Primary Examiner*—William Stryjewski

*Attorney, Agent, or Firm*—Shoemaker and Mattare Ltd.

[57] ABSTRACT

A mechanism is provided for receiving a web with intermittent motion and converting it to uniform motion, particularly for severed carton items. A reciprocating carriage has first and second adjacent idler rollers and a third idler roller spaced away from the first two. A driven roller has a fixed axis and is located with respect to the third idler roller such that the web when strung between the first and second rollers and thence around the third roller and thence around the driven roller, assumes a quasi-boustrophedonic configuration such that the portion of the web between the third idler roller and the driven roller decreases when the carriage moves in the direction which decreases the distance between them. Upper an lower endless belts pass partially around the first and second rollers, thence around the third idler roller, thence around the driven roller, thence along different respective return paths. The driven roller is rotated at substantially constant speed, and the carriage is moved in said first mentioned direction when the web movement has been arrested, and in a second direction opposite the first direction when web movement resumes.

10 Claims, 1 Drawing Sheet

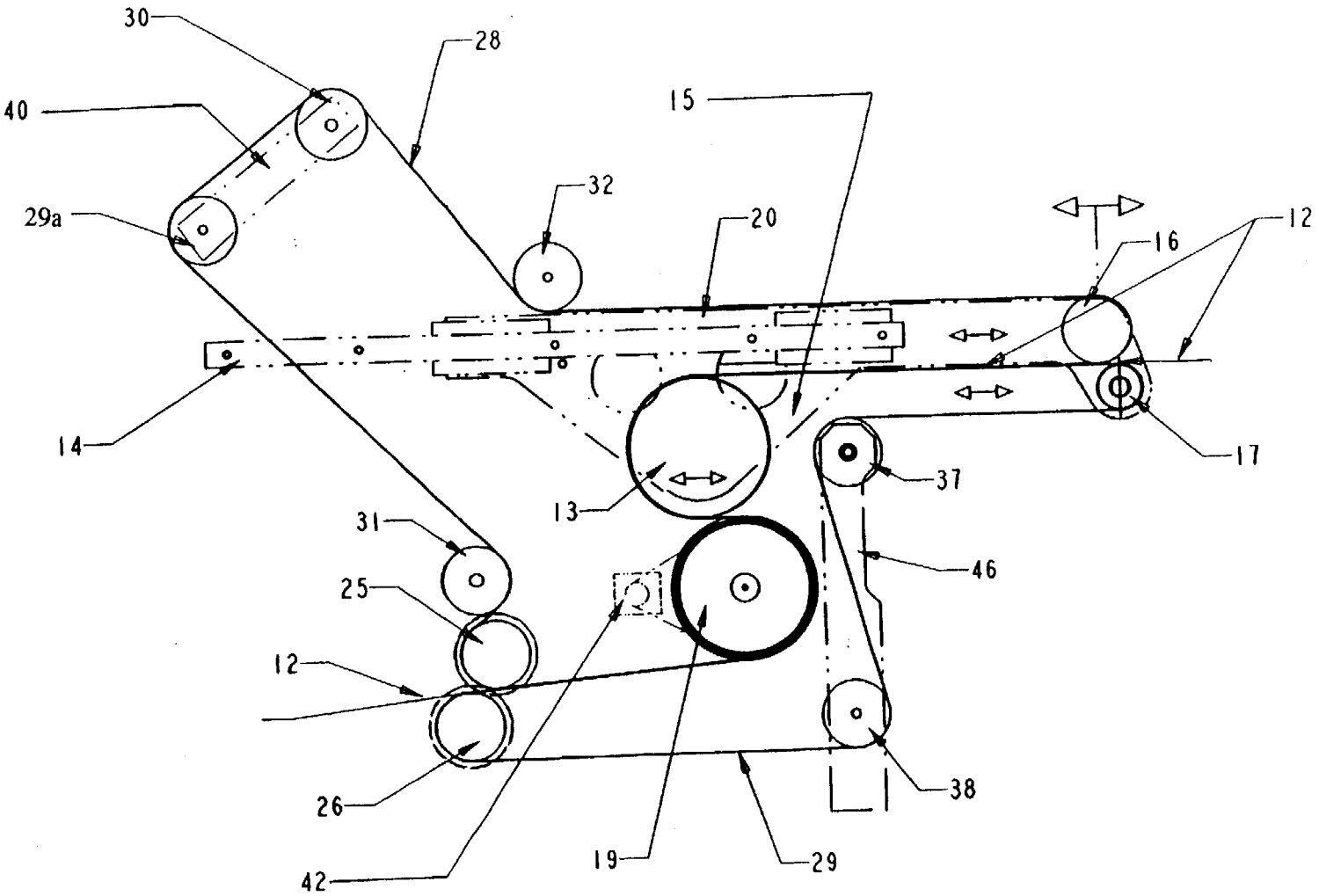
FIGURE #1

MECHANISM FOR CHANGING A WEB FEED FROM INTERMITTENT TO CONSTANT MOTION

This invention relates generally to mechanisms for changing a web feed from intermittent to constant motion, and has to do particularly with an improved mechanism of this kind, particularly suited to working with carton board web or any other type of material being transported in unsupported web form through a cutting mechanism.

BACKGROUND OF THIS INVENTION

Carton board web, after being printed, is cut and creased in a diecutter. Generally, movement of the web through the diecutter is intermittent, with the web being indexed forwardly, by appropriate carriage mechanism(s), through a cycle which includes coming to a full stop to allow diecutting to take place, then advancing to bring the next portion of the web to the diecutter, another full stop for diecutting, and so on. After being cut, the only means by which the cut parts (cartons) are restrained with respect to each other is via nicks that tie the parts to the scrap portion (matrix) of the cut web.

It is known to use an S-path outfeed draw mechanism in a decutter for labels, to change intermittent to uniform motion. Because the cut labels are supported, i.e. still held on a carrier web, there is no difficulty in having the labels pass through the S-path. The liner or carrier web serves to locate the labels relative to each other.

However, in the case of cut cartons, with only nicks to tie them together, an attempt to pass the cut parts through an S-path would result in the parts breaking away from the matrix and departing from the intended web path. On conventional carton machines currently in use, this problem has been circumvented by using a straight web path exiting from the diecutter. Of course, the disadvantage of the latter arrangement is that the parts, still held in the matrix, exit from the apparatus with the same stop/start intermittent motion produced by the carriage mechanism(s) in the diecutter.

It would be preferable to have parts exit at a uniform continuous speed instead of the stop/start motion associated with the straight exit web path format. Motion at a uniform speed facilitates subsequent operations performed on the parts, such as: stripping, conveying and stacking (mainly because of the minimization of mechanism accelerations). For example, it is less difficult to strip cartons with a rotary device than a reciprocating device, and in addition it is faster.

GENERAL DESCRIPTION OF THIS INVENTION

In view of the foregoing disadvantages of the conventional approach, this invention proposes an S-wrap mechanism that utilizes a dual enveloping belt arrangement to entrap the cut carton board parts as they exit from the diecutter with intermittent movement. The trapping action of the belts facilitates the transportation of the parts and related matrix through the S-path geometry that is required to produce uniform output velocity. Such an arrangement is able to control the position of the parts relative to each other (part-to-matrix nicks are maintained) as they travel through the S-path.

The development disclosed herein has the following features:

The concept of enveloping belts for web/part control;

A reciprocating web entry point to the mechanism

The possibility of minimizing the speed differential between the two belts (necessary to avoid breakage of nicks).

The latter feature is accomplished by using very thin section belts, and by ensuring that the top belt has a much lower coefficient of friction, where it contacts the parts being guided, than does the lower belt. The result of this is that the lower belt determines the motion profile, because some relative slippage between the top belt and the part/lower belt is permitted.

In a preferred embodiment, one set of top and lower belt idlers are geared together, which produces a bias that acts to synchronize the belt speeds.

Conventional machines often use crowned or cambered idlers for belt guiding. For the present mechanisms, however, it is preferred that the idlers be cylindrical and without camber. Instead, each belt is equipped with its own lateral web guide, whereby the lateral location of each belt can be independently controlled so as to counter any steering influence from the other belt.

More particularly, this invention provides, for use with a machine through which an elongate web passes with intermittent movement consisting of arrested motion alternating with forward motion; the machine having means for performing operations on the web when web motion is arrested:

- a mechanism for receiving the web exiting said machine and for changing the nature of the web movement from intermittent to uniform motion, comprising:
  - a carriage mounted for reciprocating movement with respect to said machine,
  - first and second adjacent idler rollers mounted for free rotation on said carriage,
  - a third idler roller mounted for free rotation on said carriage, said third idler roller being spaced away from said two adjacent idler rollers,
  - a driven roller mounted for rotation about an axis which is fixed with respect to the machine and is located with respect to the third idler roller such that the web, when strung between the first and second idler rollers thence around the third idler roller thence around said driven roller, assumes a quasi-boustrophedonic configuration whereby the portion of the web between the third idler roller and the driven roller decreases when the carriage moves in a direction which decreases the distance between the third idler roller and the driven roller;
  - an upper and a lower endless belt passing in juxtaposed relation between said first and second idler rollers, thence around the third idler roller, thence around the driven roller, thence along different respective return paths to said first and second idler roller;
  - drive means for positively rotating said driven roller at a substantially constant speed;
  - and motion generating means for moving the carriage in said first-mentioned direction, corresponding to giving up stored web, when web movement has been arrested, and for moving the carriage in a second direction opposite said first-mentioned direction when web movement resumes.

Further this invention provides, in combination:

machine through which an elongate web passes with intermittent movement consisting of arrested motion alternating with forward motion; the machine having means for performing operations on the web motion is arrested:

and a mechanism for receiving the web exiting said machine and for changing the nature of the web movement from intermittent to uniform motion, the mechanism comprising:

elongate guide rail means fixed with respect to said machine;

a carriage mounted for reciprocating movement along said guide rail means, first and second adjacent idler rollers mounted for free rotation on said carriage, a third idler roller mounted for free rotation on said carriage, said third idler roller being spaced away from said two adjacent idler rollers, a driven roller mounted for rotation about an axis which is fixed with respect to the machine and is located with respect to the third idler roller such that the web, when strung between the first and second idler rollers thence around the third idler roller thence around said driven roller, assumes a quasi-boustrophedonic configuration whereby the portion of the web between the third idler roller and the driven roller decreases when the carriage moves in a direction which decreases the distance between the third idler roller and the driven roller;

fourth and fifth idler rollers disposed adjacent one another and mounted about axes fixed with respect to the machine, the fourth and fifth idler rollers being positioned to receive web paying off said driven roller;

an upper endless belt passing between said first and second idler rollers, thence around the third idler roller, thence around the driven roller, thence between the fourth and fifth idler rollers, thence along a first return path to said first and second idler rollers;

a lower endless belt passing between said first and second idler rollers and there juxtaposed against said upper endless belt, thence around the third idler roller while located between the upper endless belt and the third idler roller, thence around the driven roller while sandwiching the upper endless belt between itself and the driven roller, thence between the fourth and fifth idler rollers where it ceases to be juxtaposed against said upper endless belt, thence along a second return path to said first and second idler rollers;

drive means for positively rotating said driven roller at a substantially constant speed;

and motion generating means for moving the carriage in said first-mentioned direction, corresponding to given up stored web, when web movement has been arrested, and for moving the carriage in a second direction opposite said first direction when web movement resumes.

GENERAL DESCRIPTION OF THE DRAWING

The single FIGURE of the drawing is a somewhat schematic side elevational view of the essential components of the mechanism to which this invention is directed.

DETAILED DESCRIPTION OF THE DRAWING

Guide rails 14 are fixed with respect to a stationary frame (not illustrated in the schematic drawing), which in turn is fixed with respect to the stamping and die-cutting machine from which the web is proceeding with a stop-start, intermittent motion. An outfeed carriage 15 is mounted on the guide rails 14 for reciprocating movement therealong, with respect to the frame.

First and second adjacent idler rollers 16 and 17 are mounted for free rotation on the outfeed carriage 15, and specifically they are located at the rightward extremity thereof. A third idler roller 13 is also mounted for free rotation on the outfeed carriage 15, but is spaced leftwardly away from the two adjacent idler rollers 16 and 17, as can be seen clearly in the drawing.

A driven roller 19 is mounted for rotation about an axis which is fixed with respect to the machine frame, and is located with respect to the third idler roller 13 such that a web, when strung between the first and second idler roller 16 and 17, thence around the third idler roller 13, thence around the driven roller 19, assumes a quasi-boustrophedonic configuration, such that a portion of the web can be taken up between the third idler roller 13 and the driven roller 19 when the carriage 15 moves in a direction which increases the distance between the third idler roller 13 and the driven roller 19 (i.e. move to the left as pictured in the drawing). The length of web taken up is equal to the length of web simultaneously paid out from the infeed carriage (not illustrated) forming part of the stamping and die-cutting mechanism. More specifically, looking at the drawing, if one imagines that the third idler roller 13 moves to the left while the driven roller 19 remains stationary, it will be seen that the web 12 will extend leftwardly to meet the periphery of the third idler roller 13, will encircle the third idler roller 13 half way, then will extend rightwardly to the top of the driven roller 19. If the two resulting reaches of the web are parallel, then a true boustrophedonic configuration would result. However, the aim of the present invention would be achieved, even if the two reaches of the web were not exactly parallel.

An upper endless belt 28 and a lower endless belt 29 are arranged to pass in juxtaposed relation between the first and second idler rollers 16 and 17, thence leftwardly toward the third idler roller 13, thence around the third idler roller 13, thence to and around the driven roller 19, thence along different respective return paths to the first and second idler rollers 16 and 17. More particularly, both the upper belt 28 and the lower belt 29 pass in juxtaposition from the bottom of the driven roller 19 to the space between a fourth idler roller 25 and a fifth idler roller 26, the rollers 25 and 26 being juxtaposed, at close spacing, but not providing a nip. Upon passing through the idler rollers 25 and 26, the upper and lower belts 28 and 29 separate and follow distinct paths back to the idler rollers 16 and 17, respectively.

More specifically, the upper belt 28 partly encircles the fourth idler roller 25, then partly encircles a sixth idler roller 31 which is fixed with respect to the frame, thence around two further idler rollers **29*a* and 30, thence around an additional idler roller 32, from where it extends to contact the first idler roller 16**.

The lower endless belt, upon exiting leftwardly between the fourth and fifth idler rollers 25 and 26, partly encircles the fifth idler roller 26, thence passes around further idler rollers 38 and 37, and finally to the second idler roller 17.

The idler rollers **29*a* and 30 are mounted on a web guide 40, which independently laterally locates the upper belt. Likewise, the idler rollers 37 and 38 are mounted on a web guide 46, which laterally locates the lower belt 29**.

Thus, with the exception of the three rollers 13, 16 and 17 which are secured to the movable outfeed carriage 15, and with the exception of the driven roller 19, all of the rollers are idlers which are fixed in position with respect to the frame.

Translating motion in the carriage 15 is provided by a strut attached to the infeed carriage (not shown) forming part of the diecutter. The infeed carriage receives its motion from a servo-driven mechanical motion generator, which does not form part of the present invention. Outfeed carriage motion is therefore identical to, and follows, infeed carriage motion. The roller 19 is preferably belt driven from a second servo motor located in the infeed section, this servo motor being always slaved to the motion of the printing section of the machine, thus following the line speed of the machine. A second smaller servo correction drive 42, acting through a harmonic drive to the roller 19, permits the speed of the belts to be slewed relative to the main line (web) speed. This trimming action compensates for variations in web length, such as the elongation in the web resulting from being processed in the diecutter.

The fourth and fifth idler rollers 25 and 26 are preferably geared together, which tends to promote synchronization of belt speeds.

As mentioned in an earlier section, it is preferred that the belts 28 and 29 be of relatively thin section, ideally in the region of about 31 thousandths of an inch. Also, the upper belt 28 has a much lower coefficient of friction then does the lower belt 29, which results in the lower belt determining the motion profile of the web.

In operation, recalling that the main function of the mechanism shown is to convert the movement of the cut web from intermittent to continuous motion, the cut web is drawn into the illustrated apparatus between the translating idler rollers 16 and 17 with intermittent motion, and the action of the belts 28 and 29 acting around the translating idlers 13, 16 and 17, results in the web exiting at a constant speed relative to the apparatus. The carriage movement is toward the web entry point (rollers 16 and 17) at a velocity of one-half the web (line) speed when the web is stationary relative to the apparatus, and has approximately twice the web speed as it moves away from the entry point.

While one embodiment of this invention has been illustrated in the accompanying drawing, and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. For use with a machine through which an elongated web passes with intermittent movement consisting of arrested motion alternating with forward motion; the machine having means for performing operations on the web when web motion is arrested:

a mechanism for receiving the web exiting said machine and for changing the nature of the web movement from intermittent to uniform motion, comprising:

a carriage mounted for reciprocating movement with respect to said machine, first and second adjacent idler rollers mounted for free rotation on said carriage, a third idler roller mounted for free rotation on said carriage, said third idler roller being spaced away from said two adjacent idler rollers, a driven roller mounted for rotation about an axis which is fixed with respect to the machine and is located with respect to the third idler roller such that the web, when strung between the first and second idler rollers thence around the third idler roller thence around said driven roller, assumes a quasi-boustrophedonic configuration whereby the portion of the web between the third idler roller and the driven roller decreases when the carriage moves in a direction which decreases the distance between the third idler roller and the driven roller;

an upper and a lower endless belt passing in juxtaposed relation between said first and second idler rollers, thence around the third idler roller, thence around the driven roller, thence along different respective return paths to said first and second idler rollers;

drive means for positively rotating said driven roller at a substantially constant speed;

and motion generating means for moving the carriage in said first mentioned direction, corresponding to giving up stored web, when web movement has been arrested, and for moving the carriage in a second direction opposite said first-mentioned direction when web movement resumes.

2. The mechanism claimed in claim 1, further comprising fourth and fifth idler rollers disposed adjacent one another and mounted about axes fixed with respect to the machine, the fourth and fifth idler rollers being positioned to receive web paying off said driven roller.

3. The mechanism claimed in claim 2, in which the fourth and fifth idler rollers are geared together.

4. The mechanism claimed in claim 3, in which the surface of the upper belt in contact with the web has a substantially lower surface coefficient of friction than does the lower belt.

5. The mechanism claimed in claim 2, in which the surface of the upper belt in contact with the web has a substantially lower surface coefficient of friction than does the lower belt.

6. The mechanism claimed in claim 1, in which the surface of the upper belt in contact with the web has a substantially lower surface coefficient of friction than does the lower belt.

7. In combination:

a machine through which an elongate web passes with intermittent movement consisting of arrested motion alternating with forward motion; the machine having means for performing operation on the web when web motion is arrested;

and a mechanism for receiving the web exiting said machine and for changing the nature of the web movement from intermittent to uniform motion, the mechanism comprising:

elongate guide rail means fixed with respect to said machine;

a carriage mounted for reciprocating movement along said guide rail means, first and second adjacent idler rollers mounted for free rotation on said carriage, a third idler roller mounted for free rotation on said carriage, said third idler roller being spaced away from said two adjacent idler rollers, driven roller mounted for rotation about an axis which is fixed with respect to the machine and is located with respect to the third idler roller such that the web, when strung between the first and second idler rollers thence around the third idler roller thence around said driven roller, assumes a quasi-boustrophedonic configuration whereby the portion of the web between the third idler roller and the driven roller decreases when the carriage moves in a direction which decreases the distance between the third idler roller and the driven roller;

fourth and fifth idler rollers disposed adjacent one another and mounted about axes fixed with respect to the machine, the fourth and fifth idler rollers being positioned to receive web paying off said driven roller;

an upper endless belt passing between said first and second idler rollers, thence around the third idler roller, thence around the driven roller, thence between the fourth and fifth idler rollers, thence along a first return path of said first and second idler rollers;

a lower endless belt passing between said first and second idler rollers and there juxtaposed against said upper endless belt, thence around the third idler roller while located between the upper endless belt and the third idler roller, thence around the driven roller while sandwiching the upper endless belt between itself and the driven roller, thence between the fourth and fifth idler rollers where it ceases to be juxtaposed against said upper endless belt, thence along a second return path to said first and second idler rollers;

drive means for positively rotating said driven roller at a substantially constant speed;

and motion generating means for moving the carriage in said first-mentioned direction, corresponding to given up stored web, when web movement has been arrested, and for moving the carriage in a second direction opposite said first direction when web movement resumes.

8. The combination claimed in claim 7, in which the fourth and fifth idler rollers are geared together.

9. The mechanism claimed in claim 7, in which the surface of the upper belt in contact with the web has a substantially lower surface coefficient of friction than does the lower belt.

10. The mechanism claimed in claim 2, in which the surface of the upper belt in contact with the web has a substantially lower surface coefficient of friction than does the lower belt.

* * * * *